US005166697A

United States Patent [19]

Viladevall et al.

[11] Patent Number: 5,166,697

[45] Date of Patent: Nov. 24, 1992

[54] COMPLEMENTARY BOWTIE DIPOLE-SLOT ANTENNA

[75] Inventors: Eduardo E. Viladevall, Northridge; William N. Moule, Calabasas, both of Calif.

[73] Assignee: Lockheed Corporation, Calabasas, Calif.

[21] Appl. No.: 646,895

[22] Filed: Jan. 28, 1991

[51] Int. Cl.[5] ..... H01Q 9/28; H01Q 21/24

[52] U.S. Cl. ..... 343/727; 343/730; 343/767; 343/770; 343/795; 343/807

[58] Field of Search ..... 343/725, 727, 729, 730, 343/795, 767, 770, 807-809, 846, 853, 893, 705

[56] References Cited

U.S. PATENT DOCUMENTS 3,193,831 7/1965 Yang ..... 343/792.5

3,266,044 8/1966 Bresler ..... 343/792.5

*Primary Examiner*—Michael C. Wimer

*Attorney, Agent, or Firm*—Louis L. Dachs

[57] ABSTRACT

The antenna system includes a complementary "bowtie" dipole-slot antenna, the antenna having symmetrical halves about a plane of symmetry. The two halves of the antenna are slanted at the plane of symmetry such that the total included angle between the halves is between 70 degrees and 120 degrees. A ground plane is positioned between the halves of the antenna extending through the plane of symmetry. A circuit is included for independently exciting the halves of the antenna. In a second embodiment the ground plane incorporates a pair of notch antennas. Thus, both vertical and horizontal polarization can be achieved independent of each other.

11 Claims, 5 Drawing Sheets

FIG. 3
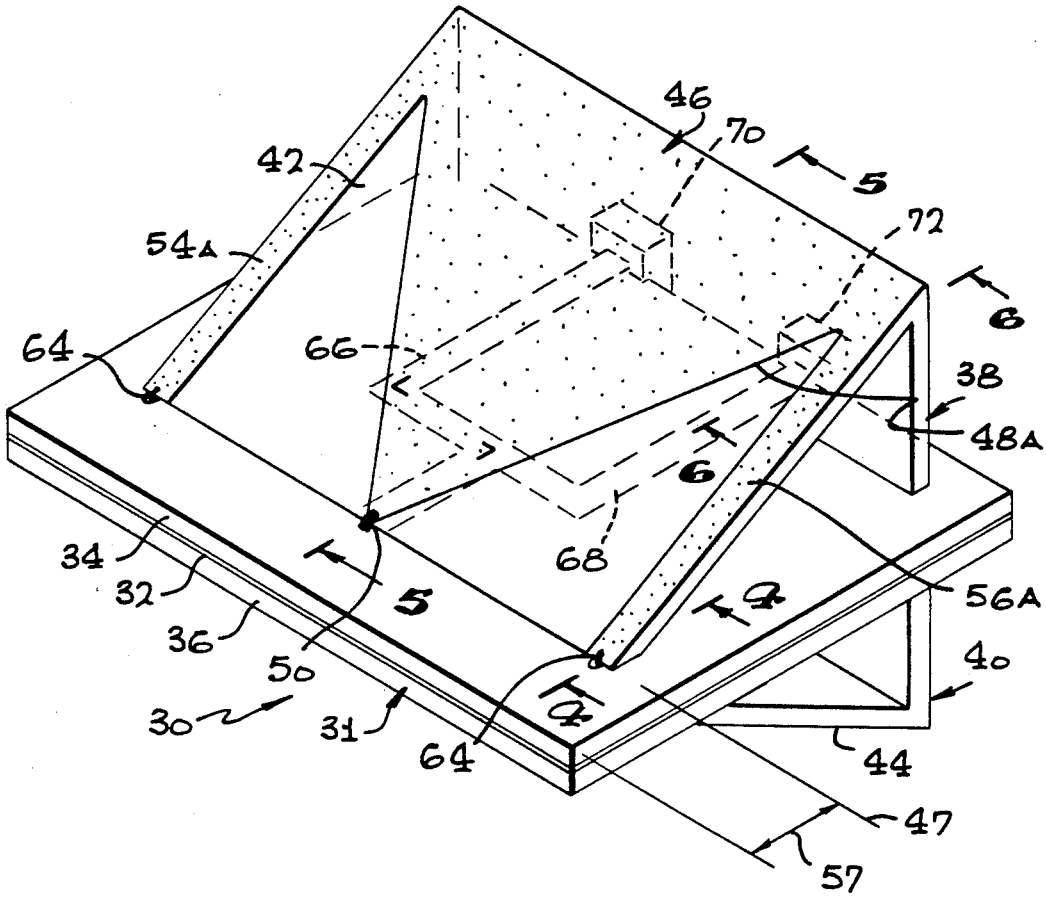
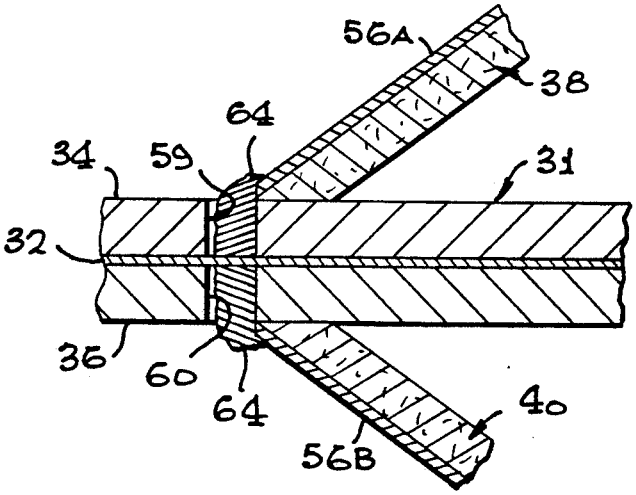
FIG. 4

FIG. 5
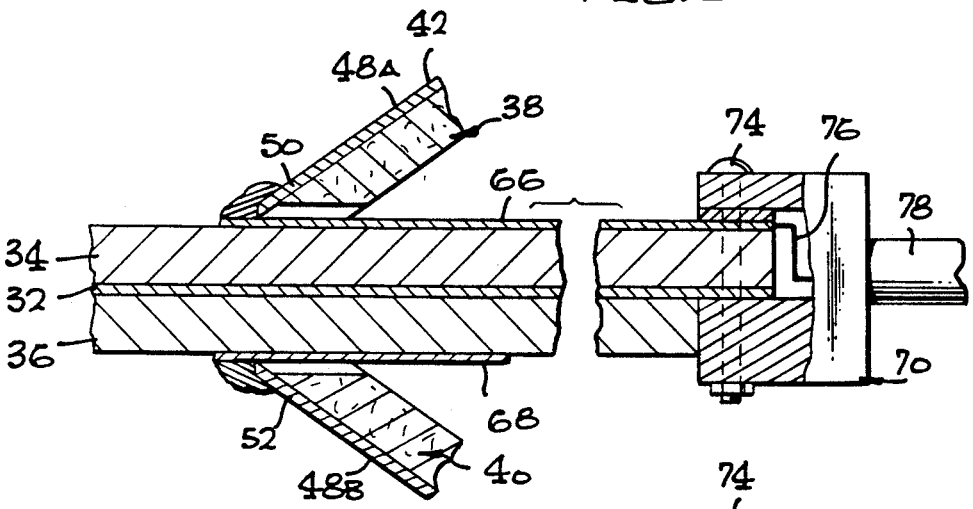
FIG. 6
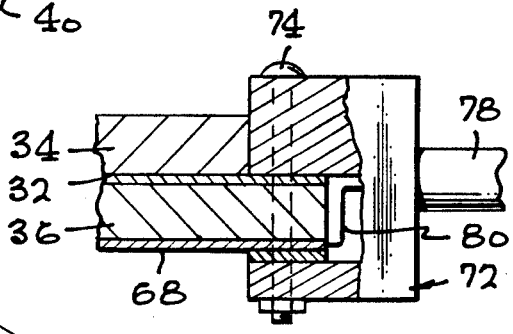
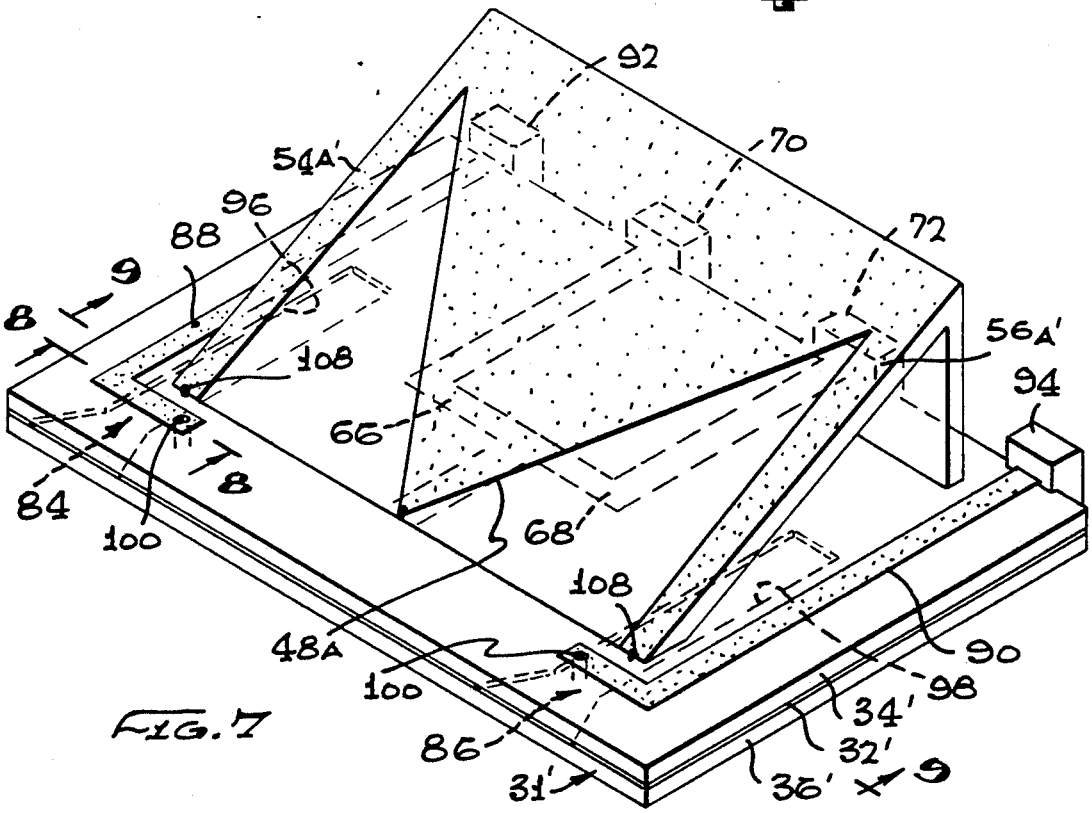
FIG. 7

FIG. 8
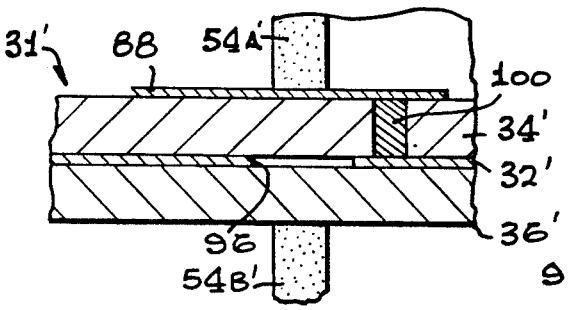
FIG. 9
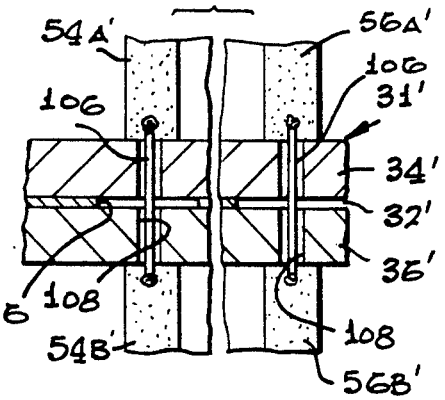
FIG. 10
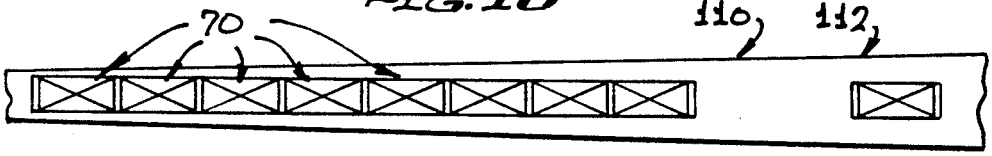
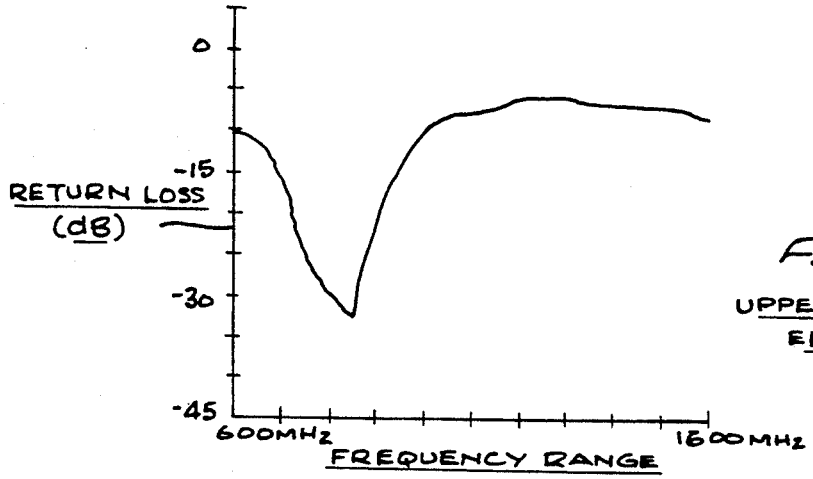
FIG. 11
UPPER VERTICAL ELEMENT
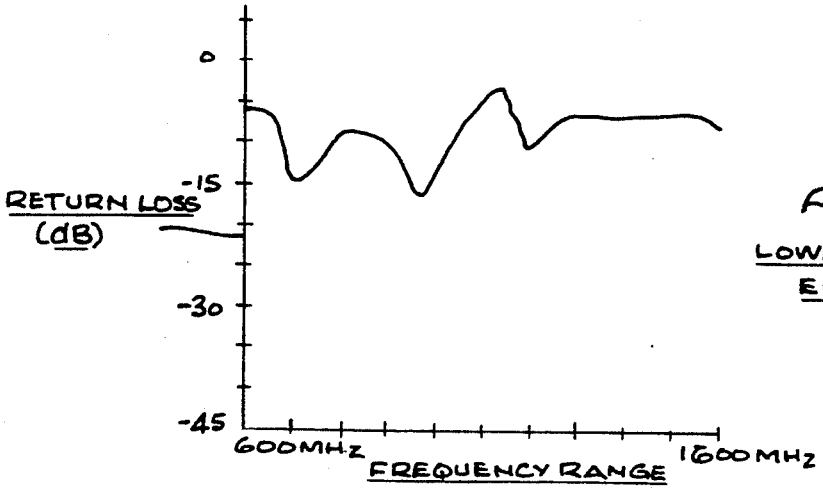
FIG. 12
LOWER VERTICAL ELEMENT

HORIZONTAL ELEMENT

UPPER VERTICAL ELEMENT
1060MHz ELEVATION PATTERN

LOWER VERTICAL ELEMENT
1060MHz ELEVATION PATTERN

HORIZONTAL ELEMENT
1315MHz AZIMUTH PATTERN

COMPLEMENTARY BOWTIE DIPOLE-SLOT ANTENNA

BACKGROUND OF THE INVENTION

1. Field of the Invention

The invention relates to the field of antennas and, in particular, to a broadband antenna system suitable for installation in the leading edge of an airfoil of an aircraft.

2. Description of Related Art

The shape of the leading edge of an airfoil is critical to the overall aerodynamic performance of the aircraft and therefore, takes precedence over most other aircraft design considerations. Unfortunately for the antenna engineer, the leading edge is an ideal location for certain of the antennas required on any modern aircraft, particularly military aircraft. For example, the leading edge of an airfoil is an ideal location for radar warning, communication, navigation and identification-friend or foe (IFF) antennas and fitting such antennas into the relatively thin wedge shape of the leading edge is difficult.

This is particularly true if a broadband antenna and/or if both horizontal and vertical polarized antennas are required. There are numerous broadband antenna designs, among the most pertinent are the complementary triangular shaped dipole-slot, log periodic, plane and spiral antenna. The complementary triangular shaped dipole-slot antenna, commonly called a complementary "bowtie" antenna, is of particular interest and consists of a conductive flat plate with two triangular shaped sections cut, leaving two triangular shaped conductive elements with a small gap between the apexes. Thus, the dipole and the space between (the dipole's complement) radiate. However, such designs cannot be fit into the leading edges of airfoils.

Thus it is a primary object of the subject invention to provide a compact broadband antenna.

It is another primary object of the subject invention to provide a compact broadband antenna that is suitable for installation in the leading edge of an airfoil.

It is a further object of the subject invention to provide a compact broadband antenna that can include direction finding capability.

It is a still further object of the subject invention to provide a compact broadband antenna that provides both horizontal and vertical polarizations.

SUMMARY OF THE INVENTION

The invention is a compact broadband antenna system suitable for incorporation into the leading edge of an airfoil. The antenna system includes a complementary "bowtie" dipole-slot antenna, the antenna having symmetrical halves about a line of symmetry. The two halves of the antenna are slanted at the line of symmetry such that the total included angle between the halves is between 70 degrees and 120 degrees, preferably between 70 and 90 degrees. The dipole segment of each antenna half is generally triangular shaped, and preferably a 90 degree right triangle. A ground plane is positioned between the halves of the antenna extending through the line of symmetry with the peripheral edge portions connected to ground. A circuit is included for independently exciting the halves of the antenna from the apex of each of the triangular shaped dipoles. In this embodiment, the peripheral edge portion of each half of the complementary "bowtie" dipole-slot antenna are electrically coupled to the ground plane.

In a second embodiment, a pair of notch antennas are mounted in the ground plane. A second circuit is included for individually feeding the pair of notch antennas. In the second embodiment the peripheral edge portions of the complementary "bowtie" dipole-slot antenna pass through the notches of the notch antennas. Thus, both vertical and horizontal polarization can be achieved.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood however, that the drawings are for purposes of illustration and description only and are not intended as a definition of the limits of the invention.

BRIEF DESCRIPTION OF THE DRAWINGS

FIG. 3 is a perspective view of the antenna.

FIG. 4 is a partial cross-sectional view of the antenna illustrated in FIG. 3, taken along the line 4—4.

FIG. 5 is a partial cross-sectional view of the antenna illustrated in FIG. 3, taken along the line 5—5.

FIG. 6 is a partial cross-sectional view of the antenna illustrated in FIG. 3, taken along the line 6—6.

FIG. 7 is perspective view of a second embodiment of the invention.

FIG. 8 is a partial cross-sectional view of the antenna illustrated in FIG. 7, taken along the line 8—8.

FIG. 9 is a partial cross-sectional view of the antenna illustrated in FIG. 7, taken along the line 9—9.

FIG. 10 is a front view of the leading edge of an airfoil having an array of the second embodiment of the antenna illustrated in FIG. 7.

FIG. 11 is a graph of the return loss in dB versus frequency of the upper vertical element of the antenna.

FIG. 12 is a graph of the return loss in dB versus frequency of the lower vertical element of the antenna.

DESCRIPTION OF THE PREFERRED EMBODIMENT

Figure 1:
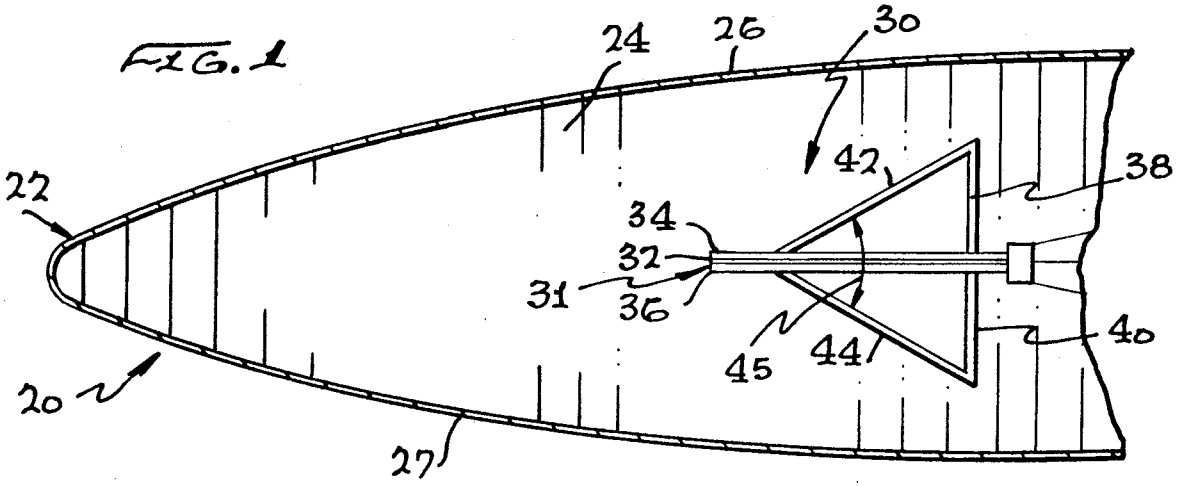
FIG. 1 is a cross-sectional view of the leading edge portion of an airfoil having the subject antenna mounted therein.
Figure 2:
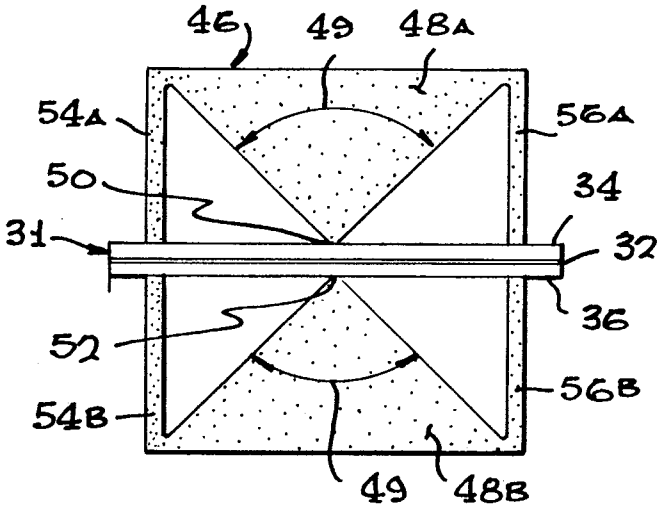
FIG. 2 is a front view of the antenna.

Shown in FIG. 1 is partial cross-sectional view of an aircraft wing, generally indicated by numeral 20, particularly illustrating the leading edge 22 thereof. The leading edge of the wing is made of a dielectric composite material in the form of a honeycomb core 24 with cover sheets 26 and 27, which can be loaded with radar absorbing material (RAM). The particular leading edge design shown is typical, but by no means is meant to be a limitation on the type of airfoils that the subject invention can be installed into. The subject antenna system, generally indicated by numeral 30, is shown installed into the leading edge 22.

Still referring to FIG. 1 and additional to FIG. 2–6, it can be seen that the antenna includes a plate 31 composed of a thin sheet 32 is approximately 0.002 to 0.005 inch thick, made of conductive material sandwiched between sheets 34 and 36 made of dielectric material and bonded thereto. The sheet 32 serves as a ground plane. Attached to the sheets 32 and 34 (preferably by bonding) and extending outward therefrom are support structures 38 and 40, respectively, having opposed slanted surfaces 42 and 44, also made of a dielectric material. The included angle 45 between the slanted surfaces 42 and 44, as will be subsequently discussed, is between 70 and 120 degrees, preferably between 70 and 90 degrees. A complementary "bowtie" dipole-slot antenna 46 is mounted on the surfaces 42 and 44 and, thus, is partially folded about its plane of symmetry 47. The dipole portions 48A and 48B each have included angles 49 of preferably, 90 degrees measured from feed points 50 and 52, respectively. However, the peripheral edge portions 54A, 54B and 56A, 56B on each side terminate in contact with the sheet 32 (best seen in FIG. 4). In FIG. 4 it can be seen that holes 59 and 60 are provided in the sheets 34 and 36 and the peripheral side edges 54A, 54B and 56A, 56B are joined by solder 64 to the sheet 32. As will be discussed in more detail, it is important that the sheet 32 extend a distance, indicated by numeral 57, at least 1.5 to 2.0 inches in front of the slanted surfaces 42 and 44 if the antenna system is operating in the 600 to 1600 mHz range.

The feed points 50 and 52 are connected to micro-strip conductors 66 and 68, respectively, mounted on the sheets 34 and 36. The micro-strip conductors 66 and 68, in turn, are electrically coupled to coax connectors 70 and 72 mounted on the back edge of the plate 31. Particularly referring to FIG. 5, it can be seen that the connector 70 is joined to the plate 31 by means of fasteners 74. A wire conductor 76 is coupled to the center conductor (not shown) for the coax line connector fitting 78 and is in electrical contact with micro-strip conductor 66. In FIG. 6, it can be seen that connector 72 is essentially identical to connector 70 except the wire conductor 80 is coupled to micro-strip conductor 68. In both instances, the connectors 70 and 72 are electrically coupled to the sheet 32 (ground plane).

A second embodiment of the antenna, similar in shape to antenna 30, is illustrated in FIGS. 7–9 and indicated by numeral 81. Thus, components that are identical to those on antenna 30 have identical numbers, those that are modified are indicated by the identical number with a "prime" symbol attached thereto and new components, of course, have appropriate new identifing numerals. The main difference is the inclusion of two notch antennas 84 and 86 in the sheet 32' of the plate 31', which are fed micro-strip conductors 88 and 90, respectively, mounted on sheet 34'. The micro-strip conductors 88 and 90 are connected to coax-connectors 92 and 94, respectively, at one end and extend across the notches 96 and 98 and connect to the sheet 32' via solder filled holes 100 in the sheet 34 (best seen in FIG. 8). The connectors 92 and 94 are identical to the connector 70 and, thus, need not be further discussed. The peripheral edge portions 54A' and 54B' are aligned with the notch 96 and are electrically connected together via wire 106 which extends through the notch via hole 108 in the sheets 32' and 34' (best seen in FIG. 9). The edge portions 56A' and 56B' are aligned with the notch 98 and are electrically connected together in a similar manner.

Note that the edge portions 54A', 54B' and 56A', 56B' do make contact with the sheet 32'. Furthermore, the wires 106 have little or no effect on the performance of the notch antennas 84 and 86, because they are very small in diameter when compared to the size of the notches 96 and 98. The need to have the edge portions so aligned with the notches is due to the requirement to maintain similar spacing between the notch antennas and the complementary "bowtie" slot-dipole antenna.

As illustrated in FIG. 10, it is envisioned that the second embodiment would be placed in the leading edge 110 of the wing 112 in a repeating pattern or array. This would allow steering of the horizontal array with a significant direction finding capability.

While considerable leeway in the design is evident from the foregoing description, there are some significant design limitations that must be observed. The included angle 45 between the surfaces 42 and 44 of between 70 and 120 degrees is important, for below 70 degrees or above 120 degrees, performance drops off. In particular, the return loss decreases and gain decreases. While performance appears to peak at about 90 degrees, the lower figure of 70 degrees is more desirable due to design requirements of the leading edge of the aircraft wing. As previously mentioned, another limitation that must be observed is the requirement that the sheet 32 (ground plane) extend a minimum of 1.5 inches forward from the front of the antenna 46 if the antenna is operating in the 600 mHz to 1600 mHz range (L band EW frequency regime). In general, the further the ground plane extends forward of the antenna 46, the better the performance thereof; however, the benefits diminish very rapidly after a distance of 2 inches. Reducing the extension below 1.5 inches causes a significant loss in vertical discrimination sensitivity. Of course, at higher or lower frequency ranges the minimum distance would decrease or increase, respectively.

Figure 13:
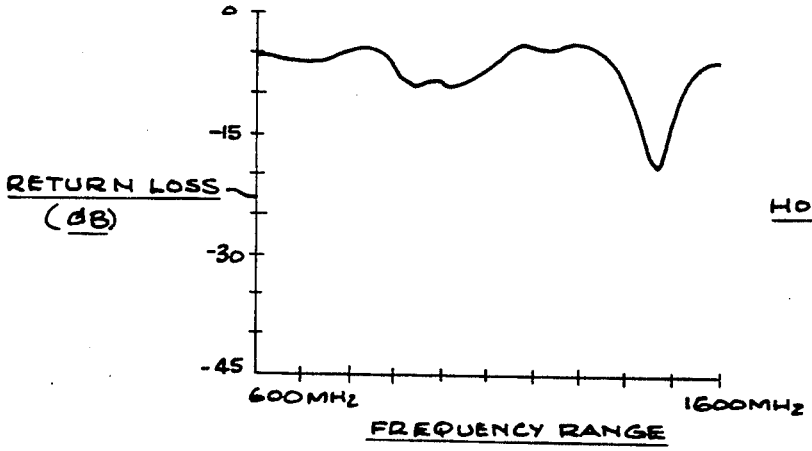
FIG. 13 is a graph of the return loss in dB versus frequency of the horizontal element of the antenna.
Figure 14:
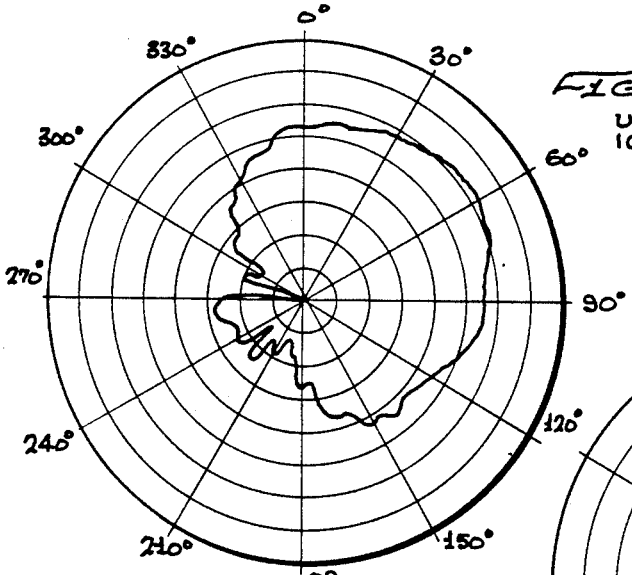
FIG. 14 is a graph of the azimuth pattern of the upper vertical element of the antenna.
Figure 15:
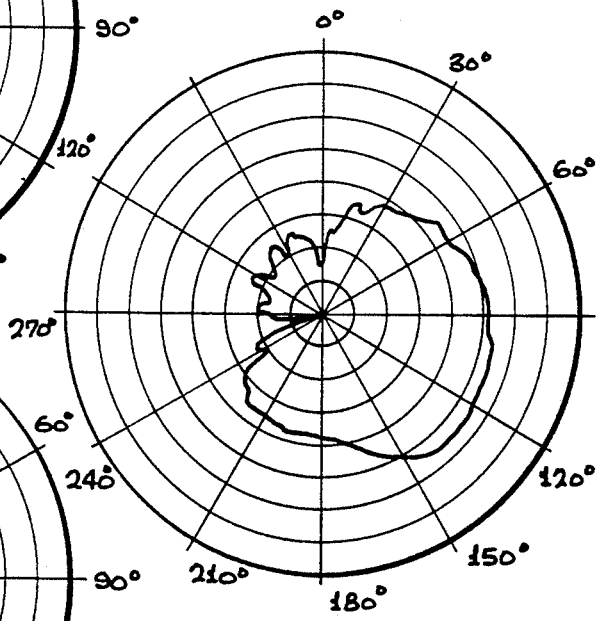
FIG. 15 is a graph of the azimuth pattern of the lower vertical element of the antenna.
Figure 16:
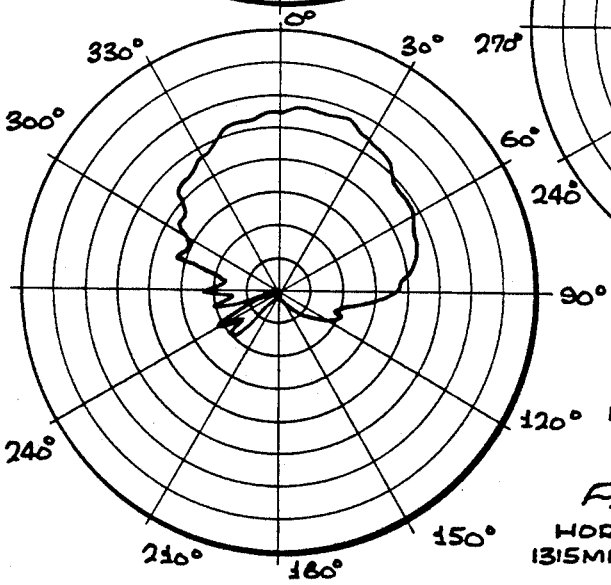
FIG. 16 is a graph of the azimuth pattern of the horizontal element of the antenna.

The performance of the antenna system is illustrated in FIGS. 10–15. In FIGS. 11–13, the return loss in dB versus frequency is plotted over the frequency range of 600 to 1600 mHz (typical IFF frequency range) for the upper vertical element, lower vertical element and horizontal element, respectively. Note that a 5 dB return loss equates to a 75% efficiency, while a 10 dB loss equates to a 90% efficiency and a 15 dB loss equates to a 97% efficiency. In FIGS. 14, 15 and 16, the azimuth pattern for the upper and lower vertical elements and horizontal vertical elements, respectively, are presented.

Because the upper and lower vertical elements have offset patterns, it can be readily seen that these elements can provide an indication of the vertical direction of the incoming signal. All that is necessary is to: 1) determine which incoming signal is strongest; 2) subtract the stronger signal from the weaker; and 3) calculate the vertical angle from a table. This whole procedure is a simple matter for a pre-programmed computer to handle. Of course, as previously stated, the horizontal element, if placed in an array, can provide an indication of the horizontal direction of a horizontally polarized incoming signal.

While the invention has been described with reference to particular embodiments, it should be understood that the embodiments are merely illustrative, as there are numerous variations and modifications which may be made by those skilled in the art. Thus, the invention is to be construed as being limited only by the spirit and scope of the appended claims.

INDUSTRIAL APPLICABILITY

The invention has applicability to the electronics industry and, in particular, to those portions of the electronics industry involved in the manufacture of antennas.

We claim:

1. An antenna system comprising:

a complementary bowtie dipole-slot antenna having dipole portions, peripheral edge portions, and slot portions defined by said dipole portions and said peripheral edge portions, said antenna having symmetrical halves about a plane of symmetry with each half including a said dipole portion, said halves slanted at said plane of symmetry such that the total included angle between said halves is between 70 degree and 120 degrees;

a ground plane positioned between said halves of said antenna coincident through said plane of symmetry; and circuit means for independently exciting said halves of said antenna.

2. The antenna system as set forth in claim 1 wherein said included angle is between 70 degrees and 90 degrees.

3. The antenna system as set forth in claim 2 including:

the dipole portion of each of said antenna halves are generally triangular shaped with the apexes thereof contingent to each other; and said means to excite said antenna halves is coupled to said apexes of said triangular shaped dipole portions.

4. The antenna system as set forth in claim 3 wherein said included angle at said apexes is generally 90 degrees.

5. The antenna as set forth in claim 4 wherein the peripheral edge portion of each half of said complementary bowtie dipole-slot antenna are electrically coupled to said ground plane.

6. An antenna system comprising:

a complementary bowtie dipole-slot antenna having dipole portions, peripheral edge portions, and slot portions defined by said dipole portions and said peripheral edge portions, said antenna having symmetrical halves about a plane of symmetry with each half including a said dipole portion, said halves slanted at said plane of symmetry such that the total included angle between said halves is between 70 degrees and 120 degrees;

a ground plane positioned between said halves of said antenna coincident through said plane of symmetry;

circuit means for independently exciting said halves of said antenna;

a pair of notch antennas, said pair of notch antennas having the notch portions thereof mounted in said ground plane; and second circuit means for individually feeding said notch antennas.

7. The antenna system as set forth in claim 6 wherein said included angle is between 70 degrees and 90 degrees.

8. The antenna system as set forth in claim 7 including:

the dipole portion of each of said antenna halves are generally triangular shaped with the apexes thereof contingent to each other; and said means to excite said antenna halves is coupled to the apexes of said triangular shaped dipole portions.

9. The antenna system as set forth in claim 8 wherein said included angle at said apexes is generally 90 degrees.

10. The antenna system as set forth in claim 9 wherein the peripheral edge portions of said complementary bowtie dipole-slot antenna pass through said notch portions of said notch antennas.

11. The antenna system as set forth in claim 3 or 5 or 9 or 10 including said ground plane extending at least 1.5 inches in front of said complementary bowtie dipole-slot antenna.

* * * * *